United States Patent [19]

Buick

[11] Patent Number: 4,479,437

[45] Date of Patent: Oct. 30, 1984

[54] EXPLOSIVE MINE

[75] Inventor: James M. Buick, Stockport, England

[73] Assignee: Ferranti Limited, Cheshire, England

[21] Appl. No.: 333,061

[22] Filed: Dec. 21, 1981

[30] Foreign Application Priority Data

Dec. 29, 1980 [GB] United Kingdom ..... 8040893

[51] Int. Cl.[3] ..... F42B 22/20

[52] U.S. Cl. ..... 102/411

[58] Field of Search ..... 102/411

[56] References Cited

U.S. PATENT DOCUMENTS 4,003,291 1/1977 Vass et al. ..... 102/411
4,274,333 6/1981 Lampton ..... 102/411

FOREIGN PATENT DOCUMENTS 216905 6/1924 United Kingdom .
235363 6/1925 United Kingdom .
287852 6/1929 United Kingdom .
362383 12/1931 United Kingdom .
582844 11/1946 United Kingdom .
1117838 6/1968 United Kingdom .

*Primary Examiner*—Charles T. Jordan
*Attorney, Agent, or Firm*—Kerkam, Stowell, Kondracki & Clarke

[57] ABSTRACT

A marine mine 10 (FIG. 4) is arranged to have a buoyancy state in which the force of gravity and/or buoyancy act on the mine in a vertical direction to move the mine through the water and includes control means operable to control guidance surfaces 16, 17, 18 projecting from the mine to impart a lateral gliding movement to the mine to steer it to intercept a target. The buoyancy state is determined by a buoyancy compartment forming part of the mine body which may be flooded to lay the mine at a submerged station. Sonar sensing means detecting a target causes air from a cartridge to displace water from the buoyancy compartment to provide an upward buoyancy force which is used to give lateral movement to the mine which is steered on a trajectory intercepting the target.

52 Claims, 8 Drawing Figures

EXPLOSIVE MINE

Figure 1:
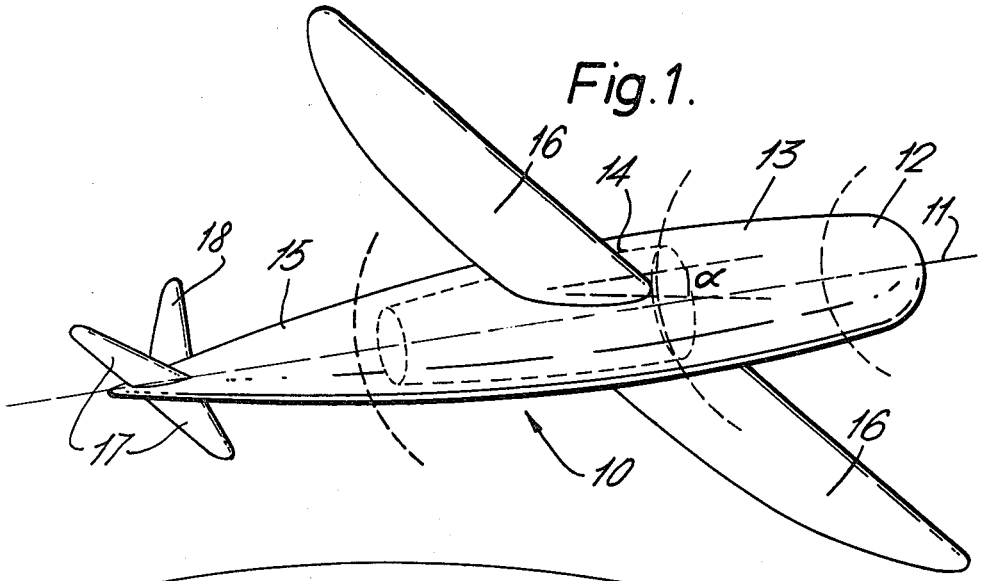

This invention relates to explosive mines and in particular to marine mines.

Marine mines are normally laid as part of a field and operate in response to contact with or acoustic or electromagnetic influence of, a target vessel. Unless a mine explodes within close proximity of the target its effectiveness is greatly reduced and whereas target detection techniques enabling mines to be sensitive at great distances have led to the expectation of more widely spaced mines within a mine field the close target proximity requirement has meant the same laying density is required.

It is an object of the present invention to provide a marine mine which permit a greater separation between mines in a field.

According to the present invention a marine mine is arranged to have a buoyancy state in which the force of gravity and/or buoyancy act on the mine in a vertical direction to move the mine through the water and includes control means operable to control guidance surfaces projecting from the mine to impart a lateral gliding movement to the mine to steer it to intercept a target.

The mine may include means operable to hold the mine submerged at a station, sensing means responsive to detection of a target to provide information to the control means for setting the guidance surfaces and launch means responsive to the sensing means to release the mine from its station with a positive buoyancy.

The means operable to cause the mine to be held submerged may comprise a buoyancy compartment arranged to be filled with liquid to achieve a negative buoyancy in which the mine rests on the sea bed and launch means operable to displace liquid in the compartment by a gas, such as air, to achieve a positive buoyancy state.

The liquid may be sea-water allowed to flood the buoyancy compartment when the mine is laid. The launch means may comprise a compressed gas cylinder or a gas generating cartridge carried by the mine from which gas is released to displace the liquid in the buoyancy compartment.

The body may be elongated having a minimum drag along a longitudinal axis along which it moves, the guidance surfaces including hydrofoil section main wings extending from the body to produce a lifting or sinking force acting transversely to the wings with a vertical component opposing the external weight or buoyancy moving the mine slowing the vertical motion of the mine and a horizontal component causing the mine to glide laterally of the launch position, elevator flaps arranged to be tilted out of the plane of the wings to alter the angle of glide and a rudder/tailplane having a control surface movable in a plane transversely to the elevator flaps to stabilise the gliding motion of the mine.

The control means may include target sensing means comprising a substantially vertical linear array of passive sonar detection elements and at least one substantially horizontal linear array of passive sonar detection elements said arrays being operable in combination to define an angle of elevation between the array and a potential target vessel and a bearing for the potential target vessel, and processing means responsive to a measurement of the depth of the mine and to the sonar detection elements to determine the range, speed and course of the target.

Figure 2:
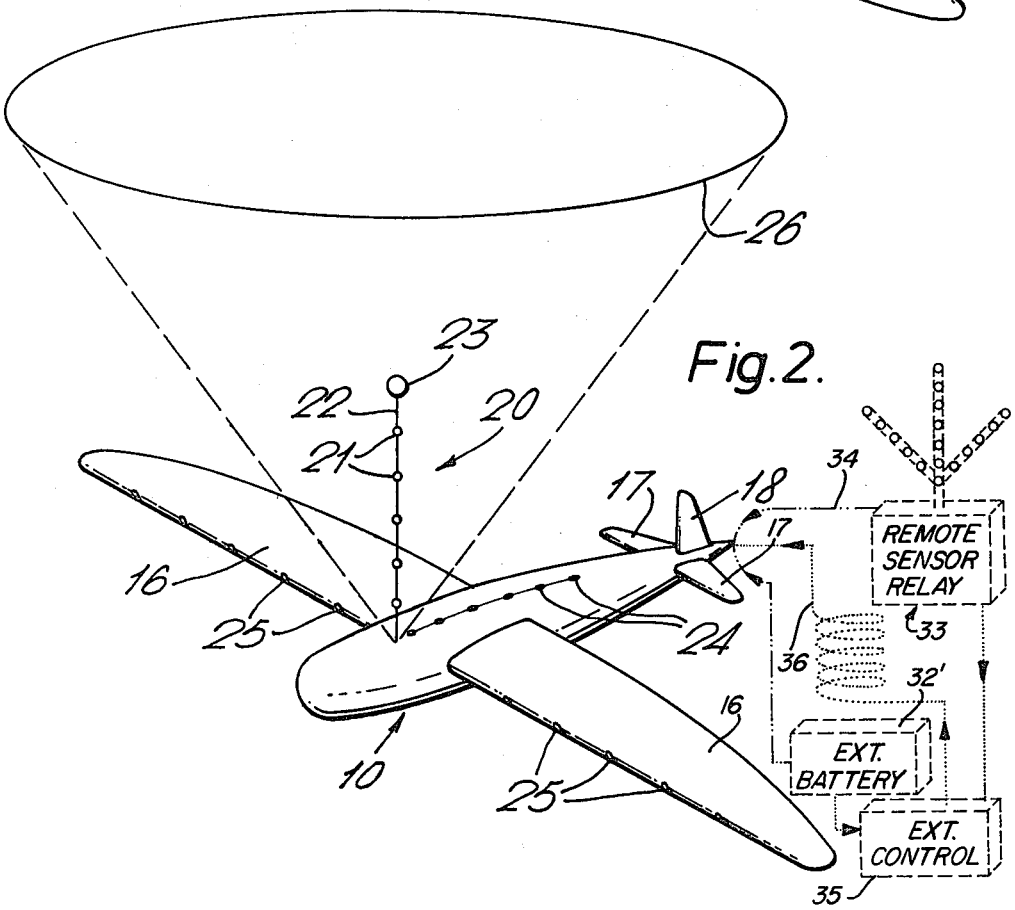
Figure 3:
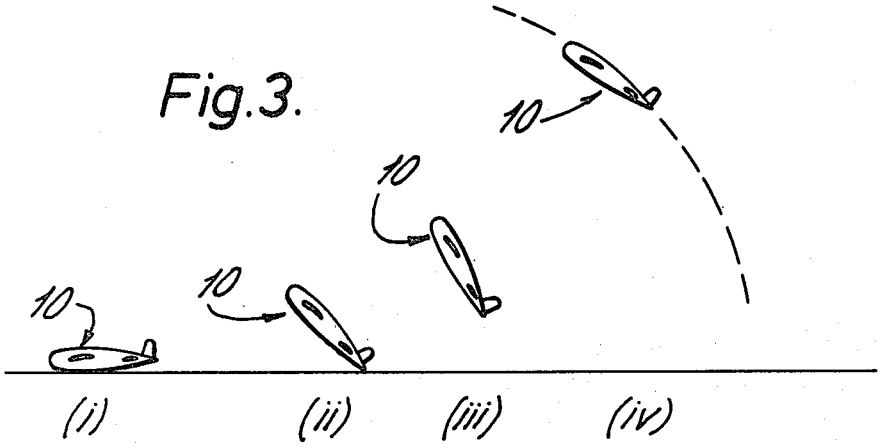
Figure 4:
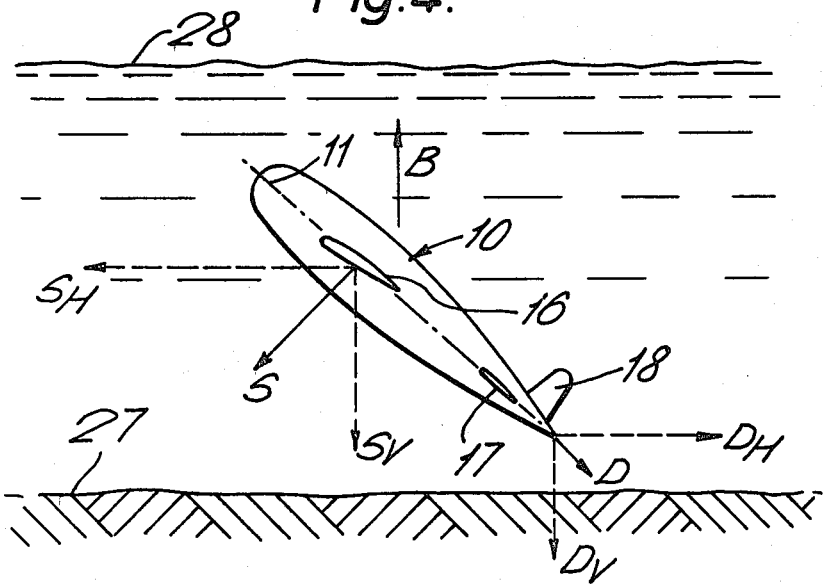

An embodiment of the present invention will now be described by way of example with reference to the accompanying drawings, in which:

FIG. 1 is a perspective view of a marine mine in accordance with the present invention, FIG. 2 is a perspective view of the mine showing a disposition of arrays of sonar detectors of the target sensing means, FIG. 3 is a side elevation of the mine showing a sequence of launching from the sea bed, FIG. 4 is an elevation of the mine gliding to the surface illustrating the principal forces acting on the mine.

Figure 5:
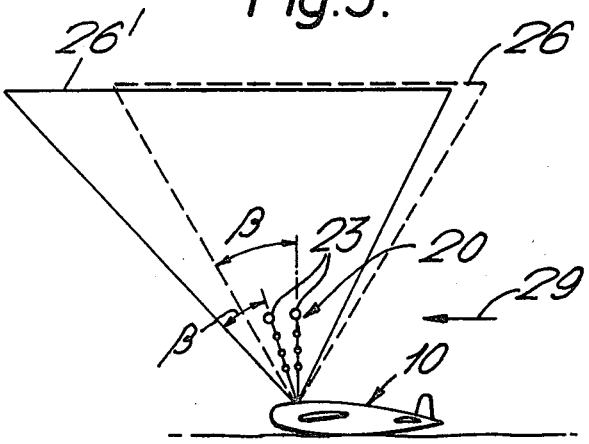
Figure 6:
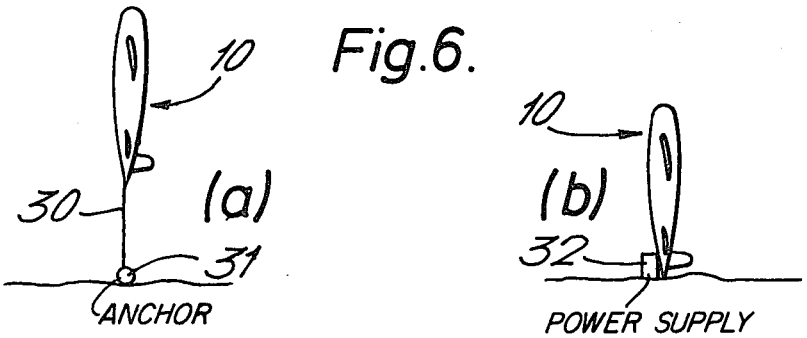
Figure 7:
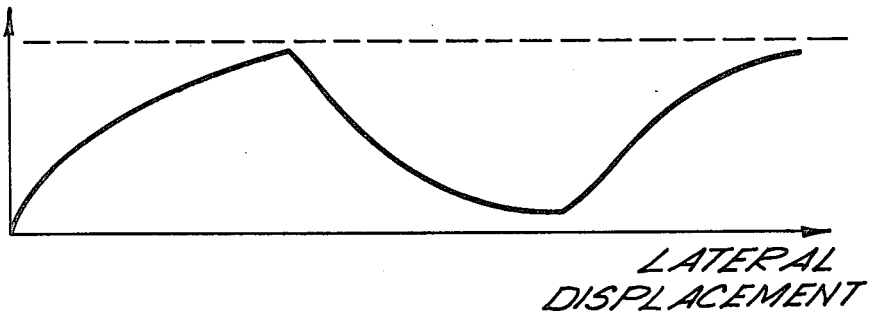

FIG. 5 is a side elevation of the mine of FIG. 3 showing the effects of sea current on the sensing means, FIG. 6(*a*) and 6(*b*) are side elevations of mines constructed according to the present invention illustrating different means of holding them submerged, and FIG. 7 shows a trajectory profile of one operating mode of the mine.

Referring to FIG. 1 a marine mine according to the present invention comprises on elongate body 10 shaped similarly to a torpedo to present a minimum drag when moving along a longitudinal axis 11 through water. The body is divided internally into sections, a nose portion 12 containing target sensing and homing equipment (not shown), a portion 13 containing the explosive payload of the mine, a buoyancy compartment 14 (coincident with the centre of gravity) and a guidance and other control equipment containing section 15.

The body is so dimensioned with respect to its weight that with the buoyancy compartment 14 filled with air or other gas, the mine has a positive buoyancy and will float to the surface from a sub-sea station.

Guidance of the rising mine is effected by guidance surfaces in the form of a pair of oppositely disposed aerofoil section main wings 16 their planes being inclined to the longitudinal axis 11 to provide an angle of incidence $\alpha$. Subsidiary wings 17 carry, or are rotatable to act as, elevator flaps for changing the attitude of the gliding mine. A rudder/tail plane 18 extends from the body transversely to the main wings and elevator flaps and carries or is rotatable to provide, a control surface, to stabilise the gliding motion of the ascending mine.

Referring now to FIG. 2 when the mine is laid the buoyancy compartment is opened to be flooded by sea-water such that it assumes a negative buoyancy state and sinks to its station on the sea bed. In this position the mine deploys and activates sonar sensing means as part of the control means. This comprises a linear array 20 of passive sonar detection elements 21 attached to a line 22 extending substantially vertically from the mine body by a buoyant float 23. Similar linear arrays 24 and 25 extending along the longitudinal axis of the body and along the wings respectively. For each linear array the sensing means receives signals detected by each detection element and from the phase relationships between them provides an indication of the angle made between the source direction and the line of the array.

The control means has a depth monitoring arrangement (not shown) so that the angle of elevation of the source as determined by the vertical array 20 is used to provide an indication of the distance of the target from the mine as represented (for a surface vessel) by the circle 26. The angle of elevation of the signal determined from the arrays 24 and 25 indicates unambiguously the position of the vessel on the circle that is, its bearing with respect to the mine. A series of time-spaced measurements provides an indication of its speed and heading. It will be understood that the range information is available from the elevation angle of any of the arrays, and others resolve any ambiguity as to position.

It will be appreciated that the relatively low motive power provided only by the buoyancy of the mine makes it unable to 'chase' powered vessels and it operates essentially to intercept those approaching its field of operation. Similarly other constraints will be recognised in respect of the lateral or glide distance as a function of ascent time whereby if the mine is required to rise quickly for the fast-approaching target its lateral range will be limited.

Such functional relationships are stored in the processing means and employed in determining whether settings required of the guidance of the surfaces to glide the mine along an ascending path which intercepts that of the target makes it a viable target.

If the target is viable the mine is 'launched' from its station into a vertical ascent from which it can enter a desired glide path in any direction.

Referring to FIG. 3 the launch sequence is shown in side elevation. The mine is initially resting on the sea-bed as shown at (1). To launch it compressed air from a cylinder (not shown) contained within the body is let into the buoyancy compartment to displace the sea water therefrom. The buoyancy compartment is arranged in sections whereby water is displaced from the front sections first causing the mine to assume a nose up attitude as shown at (ii) and (iii). At (iii) the mine is fully buoyant and proceeds to rise vertically with minimum resistance and quickly achieves a forward speed along its longitudinal axis. The elevator flaps and rudder/tailplane are adjusted to rotate the mine about its longitudinal axis and to set the mine along the desired glide path in the appropriate direction as shown at (iv).

The side elevation of FIG. 4 shows the forces which act on an ascending mine to effect lateral movement by gliding. The mine 10 is shown between the sea-bed 27 and surface 28. The buoyancy force B acts through the centre of gravity in an upward vertical direction. The mine moves along the longitudinal axis 11 and is opposed by a drag force D. The wings 16 provide a sinking force S (an inverse of the 'lift' associated with an aeroplane) acting downwardly at right angles to the drag force. The drag and sinking forces may be resolved into vertical components $D_v$ and $S_v$ which oppose the buoyancy force B and reduce the rate of rise of the mine through the water and into opposing horizontal components $D_H$ and $S_H$ which act with the net upward motive force $(B-S_v-D_v)$ so that the upward path of the mine is inclined to the vertical and the mine is caused to glide laterally of its original station.

It will be appreciated that the gliding motion of the rising mine is directly analogous to a sailplane or glider with the buoyancy B being analogous to the weight and the sinking force S being analogous to the lift produced by wings in the air. Control of the glide angle and bearing of motion is effected by manipulation of the elevator flaps 17 and rudder/tailplane 18 in the manner known for airplanes and will not be described here in further detail.

The target sensing and control means is operative throughout the glide and used to provided up-dated information of the target path and corresponding modification of the mine glide path. Such modification may also be necessary if the mine is subject to external forces such as a sea current. The homing means carried in the nose section used in the terminal phase of the ascent to instruct the guidance surfaces to direct the mine towards the target.

The effects of sea current prior to launch may be compensated for by using an effect of such a sea current on the vertical sensing array 20. Referring to FIG. 5 which shows a side elevation of the mine of FIG. 2, the vertical array 20 and float 23 indicate for a no-current condition a source at an elevation $\beta$ with respect to the array the source lying on the circle 26. If there is a current flowing in the direction of arrow 29 the float 23 and array are inclined to the vertical and any source indicated as at an elevation $\beta$ to the array will not be on the circle 26 but will be an ellipse 26' displaced downstream of it. By a suitable choice of array length the displacement of the array as a function of current and resultant difference between real and the apparent position of the source may be made to balance with the lateral drift of the ascending mine due to the current.

There may be operating conditions under which the achievement of immediate launch is paramount and FIGS. 6(*a*) and 6(*b*) shown side views of possible configurations. Referring to FIG. 6(*a*) the mine 10 is maintained in a slightly buoyant state but is prevented from rising by a cable 30 tethered to an anchor 31. The cable is attached to the tail so that the body assumes a nose-up attitude. When a viable target is sensed the cable is released and gas displaces more liquid from the buoyancy compartment to render it fully buoyant whereby the mine achieves maximum forward acceleration and is set to enter a glide path almost immediately. Referring to FIG. 6(*b*) the arrangement is similar in that the mine body is fully buoyant but the anchor is formed by a battery power supply 32 for the sensing arrangement and other internal functions required prior to launch and is attached to the tail section to achieve the nose-up attitude for the mine. By conserving the on-board source, the mine is able to operate at its station for prolonged intervals prior to launch. Again the buoyancy of the mine is at a low level to give an upward force less than the weight of the battery. To launch the mine it is simply released from the battery 32 and the buoyancy increased.

The mine may be launched from a fully buoyant state in either of the arrangements shown in FIG. 6 and the means for partial flooding of the buoyancy compartment and means for displacing the liquid therein by gas may be omitted to simplify construction. The increased buoyancy has to be counteracted by a much heavier anchor weight.

The provision of the facility of flooding and blowing the buoyancy compartment is desirable as it may be used for other than the initial launch.

For instance the lateral or glide range of the mine may be increased by alternately raising the mine in a glide and then sinking it by flooding at least a part of the buoyancy compartment. If the angle of incidence of the wings ($\alpha$) is made small the downward glide can be made by manipulation of the control surfaces. However this and other constructional features designed to give stability in the upward path may result in instability in a downward path. In such case it can be arranged for the mine to 'flip over' about its longitudinal axis so that the angle of incidence of the wings is away from the sinking force produced by the weight of the negatively buoyant mine the wings providing stable lift in a conventional sense. Whichever control method is employed in the descent phase the mine is able to glide laterally as shown in the trajectory profile in FIG. 7. The buoyancy may be changed gradually or switched when limits of depth or hydrostatic pressure are detected which is typically a short distance from the surface and the sea bed.

It will be appreciated that such a gliding descent under negative buoyancy may be employed where the mine is initially laid with negative buoyancy and in particular enables the mine or several mines to be laid at remote or dispersed stations. Also the conventional aerodynamic 'lift' configuration employed for the sinking operation means that the mine is capable of being launched through the air and into the water as a standoff weapon.

In addition to using gliding descent as a means of increasing the lateral glide range it may also be used to return the mine to a submerged station in the event of a failure to be detonated by the target. The mine includes navigation means which records the path followed between the submerged station and the target and the control means processes the information to establish a path to return the mine to the same station (sea current permitting) for use when another potential target is detected. The control means may be arranged to initiate sinking of the mine after a predetermined time has elapsed from that predicted for the intersection of the trajectories of the mine and target vessel. This has tactical advantages in that unless the mine and target vessel trajectories intersect too close to the vessel for effective avoidance the presence of the mine floating at or just below the surface may be detected visually or by sonar at the target vessel and avoiding action taken. This facility may however be overridden or delayed further by the detection of an increasing sonar signal from the target vessel indicating that the vessel is approaching and might present a viable target.

It will be appreciated that the design considerations for producing a gliding body are analogous to those for aircraft and the configurations of body and guidance surfaces are open to wide varation within the constraints of the operating environments.

There are several alternative configurations based upon combinations of features described above and illustrated by broken lines in FIG. 2. An auxilliary battery power source 32 of the type shown in FIG. 6(*b*) can be employed with the embodiment shown in FIGS. 1–5 where its weight is not used to hold the mine submerged but to provide power for prolonged operation and is jettisoned at launch.

Similarly the sensing means, particularly the sonar arrays, could be deployed separately from the mine as shown at 33, providing signals by way of cable link 34 which may be jettisoned once target parameters have been processed. This would result in a lighter and possibly more compact mine but would limit it to one launch only.

Part of the control means could also be jettisoned on launch or be external to the mine such as shown at 35 and connected thereto by a signal cable 36. Remote sensor array 33 and/or battery 32' if present may be connected to the mine by way of the external control means 35 and cable 36. The external control means may provide control guidance signals to the guidance means by the electrical cable 36 attached to the mine and payed out from the control means as the mine moves away. Again the mine would be limited to one launch only.

The mine may be fitted with navigation means to record the trajectory followed so that in the event of failure to be detonated by a target the mine is able to return to its launch station. This facility may be particularly useful where items such as sensing or control means are left at the launch station and a returned mine might 'communicate' with these means by very low power signals to enable subsequent launches to be effected.

The mine described in detail above and with its variants has related to a mine which is caused to ascend from a submerged station and possibly thereafter to descend again. It will be appreciated that in accordance with the present invention a mine may be employed which has (at least initially) a negative buoyancy which is launched from a vessel to descend to a detected target. The mine may be the self contained sophisticated weapon described above and may include means to reverse the buoyancy to float the mine in the event of it missing a submerged target such as a mine or submarine or to glide to a surface vessel some distance away by an unpredictable 'down-and-up' path.

Such a mine may however be made in simple form for tasks such as destroying submerged mines which are detectable by sonar on the hunting vessel. The mine may be controlled by guidance signals fed by electrical cable from control means on the hunting vessel and the sonar identification of the mine may be steered manually towards the target.

As an example of a mine suitable for any of the above operations a glide ratio (defined as the sine of the slope followed) of 10:1 would give a lateral range of 1000 meters from a depth of 100 meters. The dimensions of the component parts are also subject to a variety of design criteria but an explosive pay-load of 125 kg, would be carried by a body (including guidance surfaces) of 125 kg giving a total weight of 250 kg which could be packaged in a body of volume slightly less than 0.3 $m^3$. A buoyancy of 300 kg to raise the mine would require a further volume of slightly greater than 0.3 $m^3$. doing an overall volume of 0.6 $m^3$. This may be accommodated in the form illustrated by FIG. 1 having a body length of about 3 m. (with a drag coefficient of 0.1) and wingspan of 3 m. (having a drag coefficient of 0.015 and a lift coefficient of 0.4). Such an arrangement would produce a glide slope of 10:1 at approximately 10 knots.

A glide slope of 3:1 would give a reduced lateral range of operation but a corresponding increase in vertical speed and may be preferred. A mine having such a lateral limit could employ simplified control means in that as it would only be able to 'attack' vessels approaching closely the sensing means would simply guide the mine at the vessel without having to predict an intersecting trajectory.

I claim:

1. A marine mine arranged to have a buoyancy state in which the force of gravity and buoyancy act on the mine in a vertical direction to move the mine through the water and including control means operable to control guidance surfaces projecting from the mine to impart a lateral gliding movement to the mine to steer it to intercept a target and return the mine to a launch station if undetonated by the target for use when another potential target is detected.

2. A marine mine as claimed in claim 1 in which the control means includes valve means operable to alter the buoyancy of a launched mine by controlling the introduction of sea water and/or gas into a buoyancy compartment.

3. A marine mine as claimed in claim 2 in which the valve means is arranged to change the buoyancy state after the mine has failed to be detonated by a target.

4. A marine mine as claimed in claim 3 in which the valve means is arranged to change the buoyancy state after the mine has been at one extreme of its vertical travel for a predetermined period of time.

5. A marine mine as claimed in claim 4 in which the control means includes navigation means operable to record the path taken by the mine and provide the control means with instructions for returning the mine to its launch station in the event of non-detonation.

6. A marine mine as claimed in claim 1 in which a part of the control means is located to remain at the launch station and guidance signals operable to move the guidance surfaces are transmitted from the control means to the mine.

7. A marine mine as claimed in claim 6 in which the guidance signals are transmitted to the mine by an electrical cable attached to the mine and launch station and payed out as the mine moves from the launch station.

8. A marine mine as claimed in claim 1 including means operable to hold the mine submerged at a station, sensing means responsive to detection of a target to provide information to the control means for setting the guidance surfaces and launch means responsive to the sensing means to release the mine from its station with a positive buoyancy.

9. A marine mine as claimed in claim 8 in which the mine includes a gas filled buoyancy compartment maintaining a positive buoyancy state and in which the means for holding the mine submerged is an anchoring weight external to the mine from which the mine is released to float upwards.

10. A marine mine as claimed in claim 9 in which the anchoring weight is carried by the mine and holds the mine at the sea bed.

11. A marine mine as claimed in claim 10 in which the anchoring weight is an electrical battery arranged to provide power for the mine prior to launch.

12. A marine mine as claimed in claim 9 in which the anchoring weight is supported on the sea bed and the mine is tethered thereto by a cable.

13. A marine mine as claimed in claim 9 in which the buoyancy is only slightly greater than neutral and the launch means includes a gas source operable to increase the volume of gas in the buoyancy compartment to increase the buoyancy of the released mine.

14. A marine mine as claimed in claim 8 in which the means operable to hold the mine submerged comprise a buoyancy compartment arranged to be filled with liquid to achieve a negative buoyancy in which the mine rests at the sea bed and the launch means comprises a gas source operable to displace liquid from the compartment by gas to achieve a positive buoyancy state.

15. A marine mine as claimed in claim 14 in which the liquid is sea water allowed to flood into the buoyancy compartment when the mine is laid.

16. A marine mine as claimed in claim 13 in which the gas source is a compressed gas cylinder.

17. A marine mine as claimed in claim 13 in which the gas source is a chemical gas generating cartridge.

18. A marine mine as claimed in claim 13 in which the gas is air.

19. A marine mine as claimed in claim 8 in which the sensing means is arranged to be separated from the mine as the mine is launched.

20. A marine mine as claimed in claim 8 or 19 in which the sensing means comprises a substantially vertical linear array of passive sonar detection elements, said arrays being operable in combination to define an angle of elevation between the array and a potential target vessel and a bearing for the potential target vessel, and processing means responsive to a measurement of the depth of the mine and to the sonar detection elements to determine the range, speed and course of the target.

21. A marine mine as claimed in claim 20 in which the vertical array of sonar detection elements extends away from the mine supported by a buoyant float.

22. A marine mine as claimed in claim 21 in which the body and array of detection elements are arranged to be inclined to the vertical under the effects of a sea current acting on the float to such an extent that the extension of detection range in a down stream direction and reduction in detection range in an upstream direction compensate for the corresponding extension and reduction of range of the gliding mine in those directions due to the sea current.

23. A marine mine as claimed in claim 20 in which the control means is operable to predict the closest point of approach of the target and to set an intercepting course to said closest point of approach.

24. A marine mine as claimed in claim 8 in which the sensing means is operative throughout the ascent of the mine and provides updated information for control of the glide path.

25. A marine mine as claimed in claim 1 in which homing means carried by the mine and responsive to detection of a target in the vicinity of the mine's trajectory to guide the mine onto the target.

26. A marine mine as claimed in claim 1 in which the glide ratio is not less than 3:1.

27. A marine mine arranged to have a buoyancy state in which the force of gravity and buoyancy act on the mine in a vertical direction to move the mine through the water and including control means operable to control guidance surfaces projecting from the mine to impart a lateral gliding movement to the mine to steer it to intercept a target, said control means including valve means operable to alter the buoyancy of a launched mine by controlling the introduction of sea water and/or gas into a buoyancy compartment, said valve means being arranged to change the buoyancy state after the mine has failed to be detonated by a target, and control means further including navigation means operable to record the path taken by the mine and provide the control means with instructions for returning the mine to its launch station in the event of non-detonation.

28. A marine mine as claimed in claim 27 in which the valve means is arranged to change the buoyancy state after the mine has been at one extreme of its vertical travel for a predetermined period of time.

29. A marine mine as claimed in claim 27 in which a part of the control means is located to remain at the launch station and guidance signals operable to move the guidance surfaces are transmitted from the control means to the mine.

30. A marine mine as claimed in claim 29 in which the guidance signals are transmitted to the mine by an electrical cable attached to the mine and launch station and payed out as the mine moves from the launch station.

31. A marine mine as claimed in claim 27 including means operable to hold the mine submerged at a station, sensing means responsive to detection of a target to provide information to the control means for setting the guidance surfaces and launch means responsive to the sensing means to release the mine from its station with a positive buoyancy.

32. A marine mine as claimed in claim 31 in which the mine includes a gas filled buoyancy compartment maintaining a positive buoyancy state and in which the means for holding the mine submerged is an anchoring weight external to the mine from which the mine is released to float upwards.

33. A marine mine as claimed in claim 32 in which the anchoring weight is carried by the mine and holds the mine at the sea bed.

34. A marine mine as claimed in claim 32 in which the anchoring weight is an electrical battery arranged to provide power for the mine prior to launch.

35. A marine mine as claimed in claim 32 in which the anchoring weight is supported on the sea bed and the mine is tethered thereto by a cable.

36. A marine mine as claimed in claim 32 in which the buoyancy is only slightly greater than neutral and the launch means includes a gas source operable to increase the volume of gas in the buoyancy compartment to increase the buoyancy of the released mine.

37. A marine mine as claimed in claim 31 in which the means operable to hold the mine submerged comprise a buoyancy compartment arranged to be filled with liquid to achieve a negative buoyancy in which the mine rests at the sea bed and the launch means comprises a gas source operable to displace liquid from the compartment by gas to achieve a positive buoyancy state.

38. A marine mine as claimed in claim 31 in which the sensing means is arranged to be separated from the mine as the mine is launched.

39. A marine mine as claimed in claim 31 in which the sensing means comprises a substantially vertical linear array of passive sonar detection elements, said arrays being operable in combination to define an angle of elevation between array and a potential target vessel and a bearing for the potential target vessel, and processing means responsive to a measurement of the depth of the mine and to the sonar detection elements to determine the range, speed and course of the target.

40. A marine mine as claimed in claim 39 in which the vertical array of sonar detection elements extends away from the mine supported by a buoyant float.

41. A marine mine as claimed in claim 40 in which the body and array of detection elements are arranged to be inclined to the vertical under the effects of a sea current acting on the float to such an extent that the extension of detection range in a down stream direction and reduction in detection range in an upstream direction compensate for the corresponding extension and reduction of range of the gliding mine in those directions due to the sea current.

42. A marine mine as claimed in claim 39 in which the control means is operable to predict the closest point of approach of the target and to set an intercepting course to said closest point of approach.

43. A marine mine as claimed in claim 31 in which the target vessel sensing means is operative throughout the ascent of the mine and provides updated information for control of the glide path.

44. A marine mine arranged to have buoyancy state in which the force of gravity and buoyancy act on the mine in a vertical direction to move the mine through the water and including control means operable to control guidance surfaces projecting from the mine to impart a lateral gliding movement to the mine to steer it to intercept a target, said mine having a body which is elongate so as to provide a minimum drag along a longitudinal axis along which it moves, the guidance surfaces including hydrofoil section main wings extending from the body to produce a lifting or sinking force acting transversely to the wings with a vertical component opposing the external weight or buoyancy moving the mine and slowing the vertical motion of the mine and a horizontal component causing the mine to glide laterally of the launch position, elevator flaps arranged to be tilted out of the plane of the wings to alter the angle of glide and a rudder/tailplane having a control surface movable in a plane transversely to the elevator flaps to stabilize the gliding motion of the mine.

45. A marine mine as claimed in claim 44 in which the elevator flaps are mounted separately from the wings.

46. A marine mine as claimed in claim 45 in which the glide ratio is not less than 3:1.

47. A marine mine as claimed in claim 44 in which the control means includes valve means operable to alter the buoyancy of a launched mine by controlling the introduction of sea water and/or gas into a buoyancy compartment.

48. A marine mine as claimed in claim 47 in which the valve means is arranged to change the buoyancy state after the mine has failed to be detonated by a target.

49. A marine mine as claimed in claim 48 in which the valve means is arranged to change the buoyancy state after the mine has been at one extreme of its vertical travel for a predetermined period of time.

50. A marine mine as claimed in claim 47 in which the control means includes navigation means operable to record the path taken by the mine and provide the control means with instructions for returning the mine to its launch station in the event of non-detonation.

51. A marine mine as claimed in claim 44 in which a part of the control means is located to remain at the launch station and guidance signals operable to move the guidance surfaces are transmitted from the control means to the mine.

52. A marine mine as claimed in claim 44 including means operable to hold the mine submerged at a station, sensing means responsive to detection of a target to provide information to the control means for setting the guidance surfaces and launch means responsive to the sensing means to release the mine from its station with a positive buoyancy.

* * * * *